US006549101B2

(12) United States Patent
Gotoh et al.

(10) Patent No.: US 6,549,101 B2
(45) Date of Patent: Apr. 15, 2003

(54) DIELECTRIC FILTER, AND METHOD OF MANUFACTURING THE SAME

(75) Inventors: Masashi Gotoh, Tokyo (JP); Kouji Tashiro, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 09/808,166

(22) Filed: Mar. 15, 2001

(65) Prior Publication Data

US 2001/0052832 A1 Dec. 20, 2001

(51) Int. Cl.[7] ..... H01P 1/205
(52) U.S. Cl. ..... 333/202; 333/206
(58) Field of Search ..... 333/202, 206, 333/207, 202 DD, 222, 223

(56) References Cited

U.S. PATENT DOCUMENTS

| | | | | |
|---|---|---|---|---|
| 4,220,810 A | | 9/1980 | Arai et al. | |
| 5,329,687 A | * | 7/1994 | Scott et al. | 29/527.2 |
| 5,537,082 A | | 7/1996 | Tada et al. | |

FOREIGN PATENT DOCUMENTS

| | | | |
|---|---|---|---|
| EP | 0 797 266 | * | 9/1997 |
| JP | 3-240302 | | 10/1991 |
| JP | 5-63102 | | 8/1993 |
| JP | 6-53709 | | 2/1994 |
| JP | 7-147502 | | 6/1995 |
| JP | 7-176915 | | 7/1995 |
| JP | 8-307119 | | 11/1996 |
| JP | 9-260903 | | 10/1997 |
| JP | 10-41703 | | 2/1998 |
| JP | 10-242705 | | 9/1998 |
| WO | WO 95/30250 | * | 11/1995 |

* cited by examiner

*Primary Examiner*—Michael Tokar
*Assistant Examiner*—Ahn Tran
(74) *Attorney, Agent, or Firm*—Oblon, Spivak, McClelland, Maier & Neustadt, P.C.

(57) ABSTRACT

A plurality of resonators 50 are formed in a dielectric porcelain block 42, wherein each of the resonators 50 is formed by coating an interior surface of a through section with an interior conductor 54, thus constituting a dielectric filter 41. On a side surface 44 of the dielectric block 42 perpendicular to an open end face 43 having the through sections formed therein, there are formed protrusions 45 having a height L lower than that of the through sections. Terminal electrodes 60*a* and 60*b* are defined with the protrusions 45 taken as a boundary between the terminal electrodes 60*a* and 60*b*, and isolated from an exterior conductor 62.

12 Claims, 15 Drawing Sheets

DIELECTRIC FILTER, AND METHOD OF MANUFACTURING THE SAME

BACKGROUND OF THE INVENTION

The present invention relates to a dielectric filter which comprises a plurality of resonators disposed side by side and is suitable for forming input/output terminal electrodes on a side surface.

There have hitherto been proposed various types of dielectric filters, in which terminal electrodes are formed on a side surface perpendicular to an open end face of a dielectric porcelain block 42 (i.e., an exposed-dielectric surface having conductors exposed thereon).

Terminal electrodes formed on the side surface perpendicular to an open end face of the dielectric porcelain block 42 are soldered to another circuit board and act as I/O terminals of the dielectric filter. Another electrode placed on the same plane where the terminal electrodes are provided acts as a ground electrode.

Commonly-used terminal electrodes include a terminal electrode formed by means of printing and sintering conductive material, and a terminal electrode formed by means of plating (see, for example, Japanese Patent Publication 8-307119/(1996) and 9-260903/(1997)). The terminal electrode assumes a structure such as that shown in FIG. 13.

In a dielectric porcelain block 2 of the dielectric filter 1 shown in FIG. 13, a plurality of resonators 10 are provided side by side, wherein each resonator 10 is formed by coating the interior surface of a through hole 11 with an interior conductor 12. I/O terminal electrodes 20 are provided on a side surface 4 perpendicular to an open end face 3 of the dielectric porcelain block 2 having the through holes 11 formed therein. The remaining side surfaces and bottom (i.e., a surface opposite the open end face 3) of the dielectric porcelain block 2 are covered with an exterior conductor 22 such that the I/O terminal electrodes 20 are isolated from the exterior conductor 22 by means of an exposed-dielectric section 21.

There have also hitherto been proposed a method of forming independent I/O terminal electrodes, by means of metallizing the entire side surfaces of a dielectric porcelain block; forming recesses in one of the side surfaces by means of sandblasting, laser, or etching; and masking electrodes with resist before the dielectric porcelain block is metallized.

As is evident from an enlarged portion shown in FIG. 13, the terminal electrode 20 and the ground electrode (i.e., the exterior conductor 22) are higher than the exposed dielectric porcelain block 2 located therebetween by an amount corresponding to the thickness of the electrodes.

The terminal electrodes 20 are located at the highest position above amount surface of the dielectric porcelain block 2. When a dielectric filter is soldered to another circuit board by use of cream solder, the dielectric filter is mounted on a circuit board by means of squeezing cream solder, since no gap exists between a circuit board and a terminal electrode. Accordingly, if the amount of solder is greater than appropriate, a solder bridge arises between adjacent terminals, thus causing a short circuit. Occurrence of a short circuit will be described specifically by reference to FIGS. 14A through 14C.

FIGS. 14A through 14C show an example solder bridge arising in a dielectric filter having a related-art terminal electrode. As shown in FIG. 14A, a cream solder layer 33*a* is applied over an electrode 32*a*, and a cream solder layer 33*b* is applied over an electrode 32*b*. When the dielectric porcelain block 2 is mounted on the electrodes 32*a* and 32*b* laid on a circuit board 31 and is pressed against the electrodes 32*a* and 32*b*, the cream solder layers 33*a* and 33*b* squeeze out in a manner as shown in FIG. 14B, because no gap exists between a terminal electrode 20, a ground electrode (i.e., an exterior conductor 22), and a circuit board 31 of the dielectric porcelain block 2.

So long as a sufficient space exists between the electrodes 32*a* and 32*b*, occurrence of solder bridges between the electrodes 32*a* and 32*d* can be prevented. However, in a high-frequency dielectric filter which is to be used for higher frequencies and miniaturization, an interval between electrodes becomes narrower, and a short circuit due to solder bridges becomes apt to arise between the electrodes 20 and 22, as shown in FIG. 14C.

In connection with a dielectric filter, a dielectric porcelain block per se is greater in area than electrodes. Hence, the strength of a connection must be enhanced by means of increasing the area of a place to be soldered, and the amount of solder to be used must be increased. An increase in the amount of solder eventually results in ease of occurrence of a short circuit.

When terminal electrodes and a ground electrode of a dielectric filter are formed, by means of electric plating, areas where terminal electrodes are to be formed assume island-shaped geometries, and as a result plating of the terminal electrodes becomes thinner. A pattern is formed by means of resist, and hence variations may arise in positions where terminals are to be formed, depending on the precision of printing of resist, thereby adversely affecting a filtering characteristic of the dielectric filter.

In a case where electrodes are formed by means of plating, a plating bridge (elongation of plating) may arise between a terminal electrode 20 and a ground electrode (i.e., an exterior conductor 22) formed on the dielectric porcelain block 2 of the dielectric filter 1, thereby resulting in a short circuit such as that shown in FIG. 15. After removal of resist, the bridge still remains, thereby inducing a short circuit.

When molded bodies which are to become dielectric porcelain blocks are sintered, a maximum number of molded bodies are put into a furnace as close to each other as possible. If contact of large area arises between molded bodies, the molded bodies will stick to each other after sintering, thus resulting in occurrence of defectives.

SUMMARY OF THE INVENTION

The present invention is aimed at obviating drawbacks of a dielectric filter having a related-art structure and at providing a dielectric filter which is easy to mount and provides a high manufacturing yield and stable quality, as well as a method of manufacturing the dielectric filter.

Other objects and novel features of the present invention will be manifest by reference to embodiments to be described later.

To this end, the present invention provides a dielectric filter formed from a dielectric block and a plurality of resonators formed in the dielectric block side by side, each resonator being formed by coating an interior surface of a through section with an interior conductor, wherein, on a side surface of the dielectric block perpendicular to an open end face having the through sections formed therein, there are formed protrusions having a height lower than that of the through sections.

By means of such a construction, when terminal electrodes are provided on a side surface of a dielectric block, dielectric protrusions are located between the electrodes. Hence, when the dielectric porcelain block is mounted on a circuit board by means of cream solder, the amount of solder which enters the exposed dielectric of the protrusions from electrodes becomes less, thereby eliminating squeezing out of solder to adjacent electrodes. Consequently, there can be prevented occurrence of a short circuit, which would otherwise be caused by solder bridges.

One or more protrusions are provided on at least one of the side surfaces of the dielectric porcelain block during molding. As a result, there can be prevented occurrence of contact between molded bodies over a wide area. Consequently, there can be prevented failures, which would otherwise be caused when molded bodies come into contact with each other over a wide area during sintering.

Preferably, each of the protrusions is formed so as to spread across two or more side surfaces.

By means of such a construction, a terminal electrode can be provided at a corner of the dielectric block.

Preferably, a plurality of protrusions can be formed on the same plane.

By means of such a construction, a plurality of terminal electrodes can be provided on a single plate of the dielectric block.

Preferably, terminal electrodes are formed such that the protrusions are located as a boundary between the electrodes.

By means of such a construction, since protrusions have been formed on a side surface beforehand, the positional accuracy of the terminal electrodes can be improved, thereby diminishing variations in the filtering characteristic of a dielectric filter.

Preferably, the protrusions are located at least between adjacent terminal electrodes.

By means of such a construction, when terminal electrodes are provided on a side surface of a dielectric block, dielectric protrusions are located between the electrodes. Hence, when the dielectric porcelain block is mounted on a circuit board by means of cream solder, the amount of solder which enters the exposed dielectric of the protrusions from electrodes becomes less, thereby eliminating squeezing out of solder to adjacent electrodes. Consequently, there can be prevented occurrence of a short circuit, which would otherwise be caused by solder bridges.

Preferably, the protrusions are provided in a position other than the boundary between the terminal electrodes.

By means of such a construction, there can be prevented failures, which would otherwise be caused when molded bodies come into contact with each other over a wide area during sintering. Thus, the construction is effective for improving molding yield and useful for stabilizing the position of the dielectric filter when the filter is mounted to a circuit board.

Preferably, the extent to which the protrusions are to protrude from a side surface of the dielectric block is greater than the thickness of an exterior conductor formed on the side surface.

By means of such a construction, when the dielectric porcelain block is mounted on a circuit board by means of cream solder, the protrusions projecting from the exterior conductor prevents squeezing out of solder to adjacent electrodes. Consequently, there can be prevented occurrence of a short circuit, which would otherwise be caused by solder bridges.

Preferably, the interior and exterior conductor layers are formed by plating.

By means of such a construction, the terminal electrodes, the interior conductor, and the exterior conductor can be formed simultaneously by means of plating.

The present invention also provides a method of manufacturing a dielectric filter formed from a dielectric block and a plurality of resonators formed in the dielectric block side by side, each resonator being formed by coating an interior surface of a through section with an interior conductor, the method comprising the steps of: molding the dielectric block such that protrusions having a height lower than that of the through sections are formed on a side surface of the dielectric block perpendicular to an open end face having the through sections formed therein; coating the dielectric block including the surfaces of the protrusions with a conductor layer; and abrading tops of the protrusions, thereby causing the surface of the dielectric block to become exposed and forming electrodes defined by the protrusions.

By means of such a construction, when terminal electrodes are formed by means of plating, top surfaces of protrusions—which have been formed on a side surface beforehand after the entire surface of a dielectric porcelain block exclusive of an open end face has been plated—are abraded, thus eliminating the conductor layer from the top of each of the protrusions and forming terminal electrodes defined by the protrusions. The number of steps of forming a resist mask on a surface on which terminals are to be formed can be reduced. Further, protrusions are formed between terminal electrodes so as to constitute a boundary between the terminal electrodes, thereby preventing occurrence of a short circuit, which would otherwise be caused by elongation of plating. Moreover, the positional precision of electrodes can also be improved.

When the entire surface of a dielectric porcelain block is plated after resist mask has been formed over an open end face according to the related-art method, terminal electrodes become island-shaped floating electrodes. When the dielectric porcelain block is electrically plated, a reduction arises in the thickness or strength of plating. Since the present method prevents occurrence of floating electrodes, the foregoing problems do not arise. Thus, there can be formed terminal electrodes having stable strength and thickness.

The present invention also provides a method of manufacturing a dielectric filter formed from a dielectric block and a plurality of resonators formed in the dielectric block side by side, each resonator being formed by coating an interior surface of a through section with an interior conductor, the method comprising the steps of: forming the dielectric block by means of injection molding, such that protrusions having a height lower than that of the through sections are formed on a side surface of the dielectric block perpendicular to an open end face having the through sections formed therein.

By means of such a construction, protrusions of complicated shapes can be formed by means of injection molding, thereby enabling formation of terminal electrodes of various patterns.

DETAILED DESCRIPTION OF THE PREFERRED EMBODIMENTS

A dielectric filter and a method of manufacturing the dielectric filter according to the present invention will be described hereinbelow by reference to the accompanying drawings.

Figure 1:
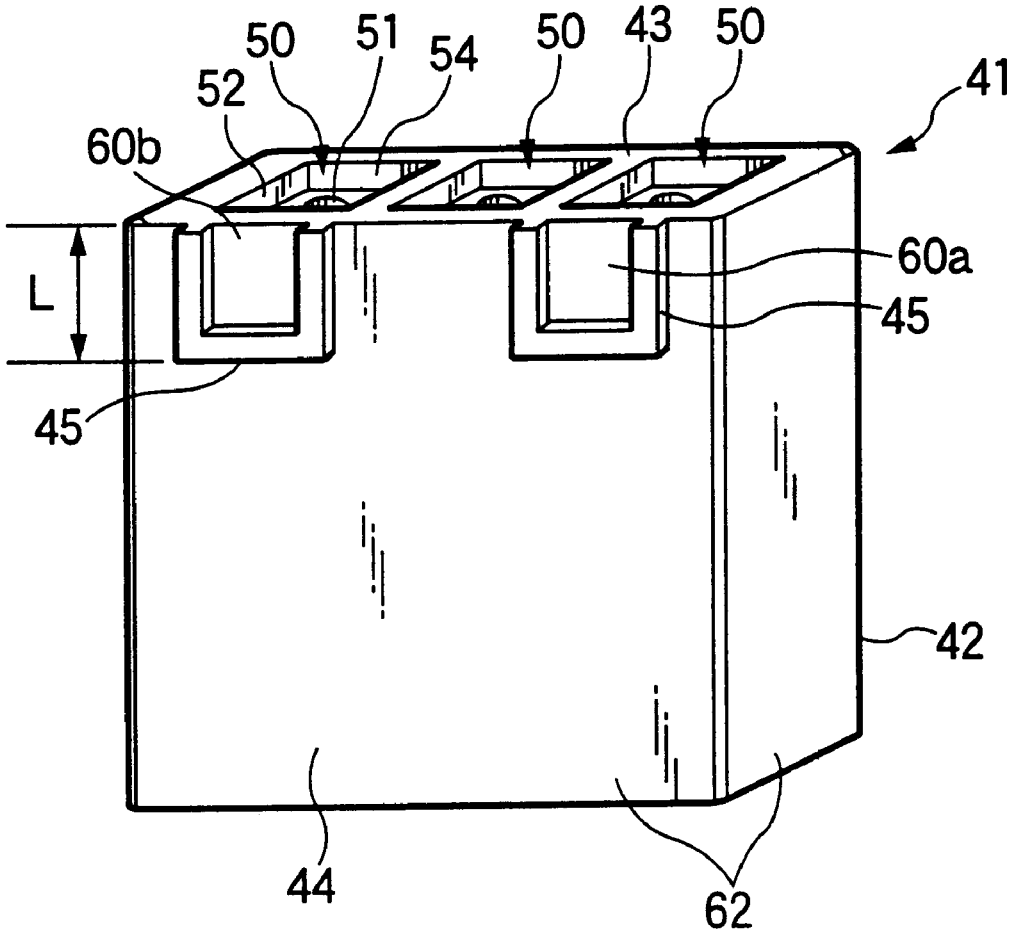
FIG. 1 is a perspective view showing a dielectric filter according to a first embodiment of the present invention.

FIG. 1 shows a dielectric filter according to a first embodiment of the present invention, and FIG. 2 shows a method of manufacturing the dielectric filter.

In the dielectric filter shown in FIG. 1, a plurality of resonators 50 are formed side by side in a dielectric porcelain block 42 serving as a dielectric block. Each of the resonators 50 is constituted by means of covering an interior circumferential surface of a through section with an interior conductor 54, and the through section is constituted of a through hole 51 and a cup-shaped recess 52 formed at one end of the through hole 51. (In the illustrated example, the length of the through section is defined as the sum of the length of the through hole 51 and the length of a cup-shaped recess 52, and three resonators are provided, thus constituting a three-stage dielectric filter). Through sections, each consisting of the through hole 51 and the cup-shaped recess 52 continuous therewith, are formed in an open end face 43 of the dielectric porcelain block 42 having a dielectric exposed thereon. Upwardly-oriented C-shaped protrusions 45 having a height L smaller than that of the through section (i.e., the height of the through hole 51 and the height of the cup-shaped recess 52) are formed beforehand integrally with the dielectric porcelain block 42 on a side surface 44 perpendicular to the open end face 43. Such a dielectric porcelain block 42 can be formed by means of injection molding so as to have the through hole 51, the cup-shaped recesses 52, and the upwardly-oriented C-shaped protrusions 45.

Here, the C-shaped protrusions 45 are set so as to protrude from the side surface 44 such that the thickness of the C-shaped protuberance 45 exceeds the thickness of I/O terminal electrodes 60*a* and 60*b* to be provided on the side surface 44 of the dielectric porcelain block 42 and the thickness of an exterior conductor (ground electrode) 62 covering the exterior surface (i.e., the side and bottom surfaces) of the dielectric porcelain block 42. The tip ends of the C-shaped protrusions 45 are arranged so as to come into contact with the open end face 43. Consequently, each of the I/O terminal electrodes 60*a* and 60*b* is defined by the respective C-shaped protuberance 45 having a dielectric exposed thereon and is electrically isolated from the exterior conductor 62 (i.e., ground electrode) covering the remaining exterior surface of the dielectric porcelain block 42. The exterior conductor 62 is connected to the interior conductor 54 covering the interior surfaces of the through holes 51 on the bottom surface (i.e., the surface opposite the open end face 43). As will be described later, the I/O terminal electrodes 60*a* and 60*b* are used for mounting the dielectric filter 41 onto a circuit board by use of cream solder.

Figure 2A:
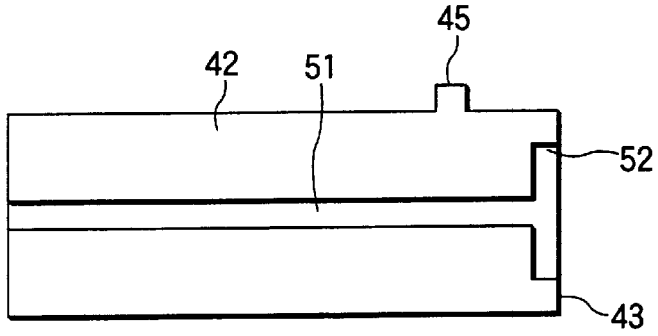
FIGS. 2A to 2C are descriptive views showing one example of a method of forming electrodes in the first embodiment.
Figure 2B:
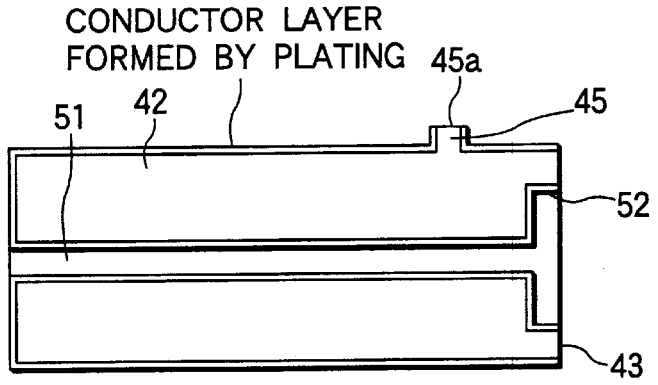
Figure 2C:
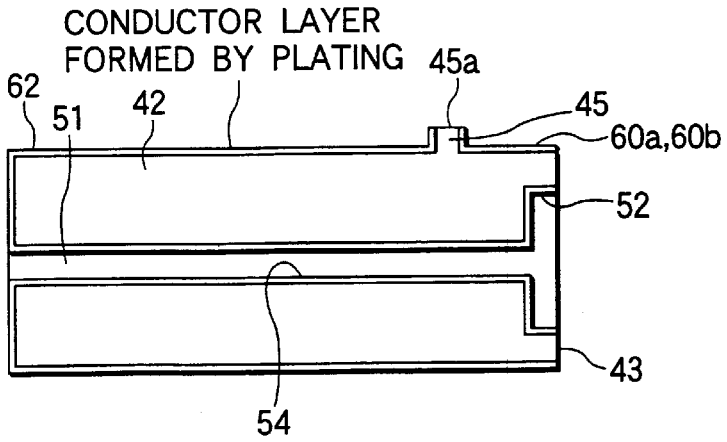

FIGS. 2A through 2C show one example of method of producing the dielectric filter 41 shown in FIG. 1. As shown in FIG. 2A, the protrusions 45 are formed on the dielectric porcelain block 42 by means of injection molding, and then the dielectric porcelain block 42 is sintered at a predetermined temperature. Next, as shown in FIG. 2B, the dielectric porcelain block 42, including the surfaces of through holes 51, the surfaces of the cup-shaped recesses 52, and the surfaces of the protrusions 45, are subjected to electroless plating, such as Cu plating. In order to facilitate plating, the surface of the dielectric porcelain block 42 is roughened beforehand, and the dielectric porcelain block 42 is plated with a catalyst.

At this time, in order to protect the open end face 43 from plating, the.dielectric porcelain block 42 is plated while the open end face 43 is coated with resist. Subsequently, either of two methods may be employed: one method is to coat the surface of the dielectric porcelain block 42 exclusive of the open end face 43 with a conductor layer by means of plating and to remove the resist from the open end face 43, as shown in FIG. 2B; and the other method is to removing the plating layer from the open end face 43 by means of abrasion after the entire surface of the dielectric porcelain block 42 has been plated. According to the method shown in FIG. 2B, an upper end face 45*a* of the protuberance 45 is also plated. However, as shown in FIG. 2C, a conductor layer provided on the upper end face 45*a* of the protuberance 45 is abraded, thereby causing dielectric of the upper end face 45*a* of the protuberance 45 to become exposed. As a result, there are produced the I/O terminal electrodes 60*a* and 60*b*, which are isolated from each other by means of the protrusions 45, and the exterior conductor (ground electrode) 62. Simultaneously, the interior conductor 54 is formed on the interior surfaces of the through holes 51 and on the interior surfaces of the cup-shaped recesses 52, by means of plating.

Figure 3A:
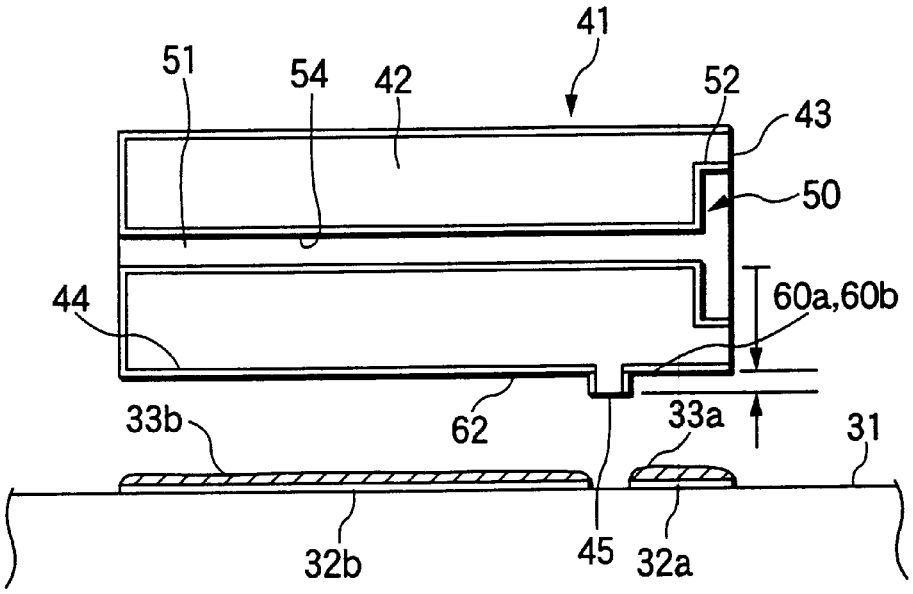
FIGS. 3A and 3B are descriptive view showing mounting of a dielectric filter to a circuit board in the first embodiment.
Figure 3B:
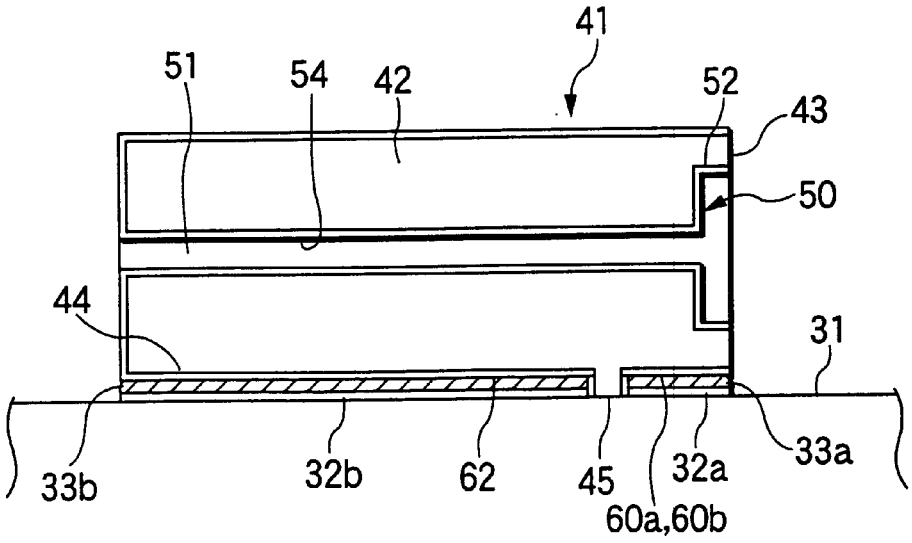
Figure 14A:
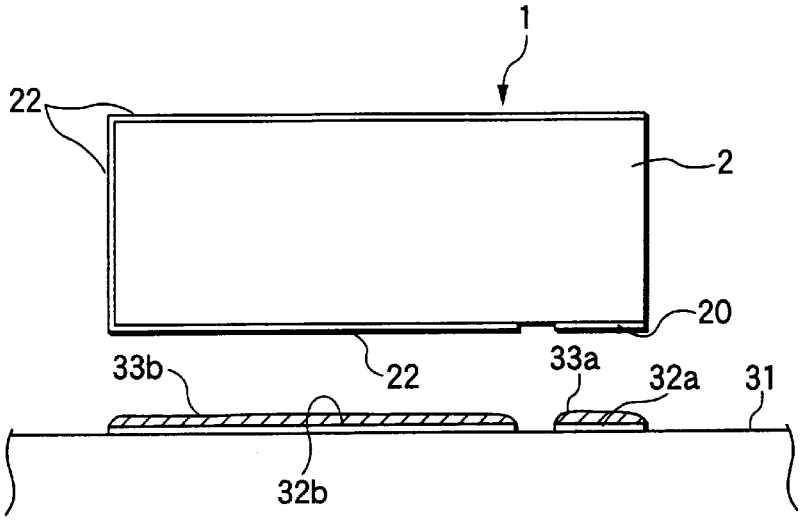
FIGS. 14A to 14C are descriptive views showing drawbacks arising when a related-art dielectric filter is mounted on a circuit board.
Figure 14B:
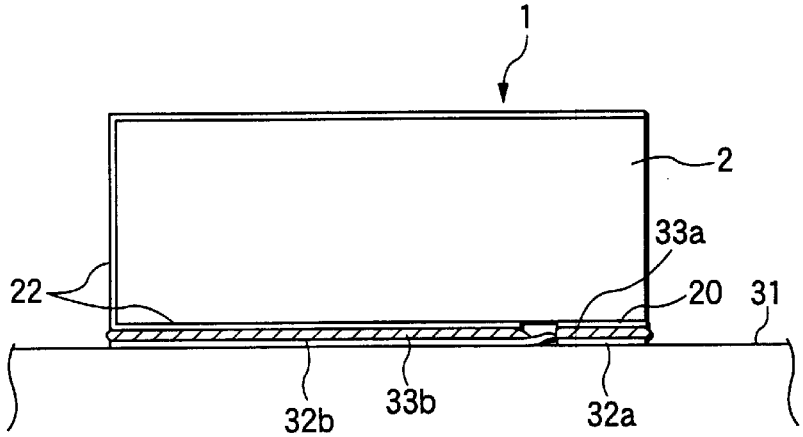
Figure 14C:
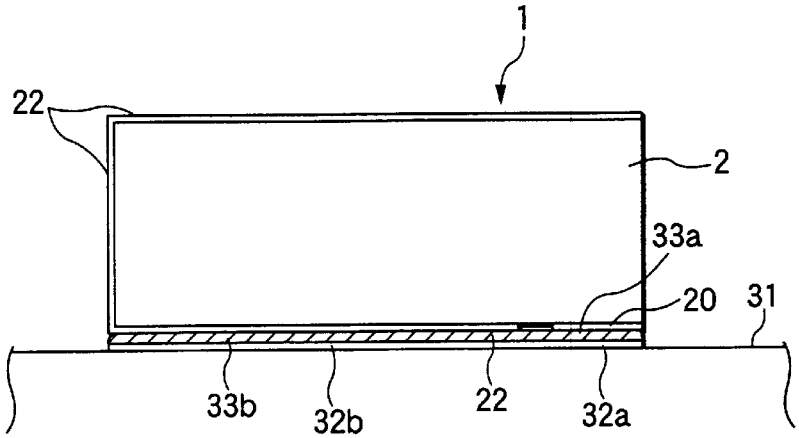
Figure 15:
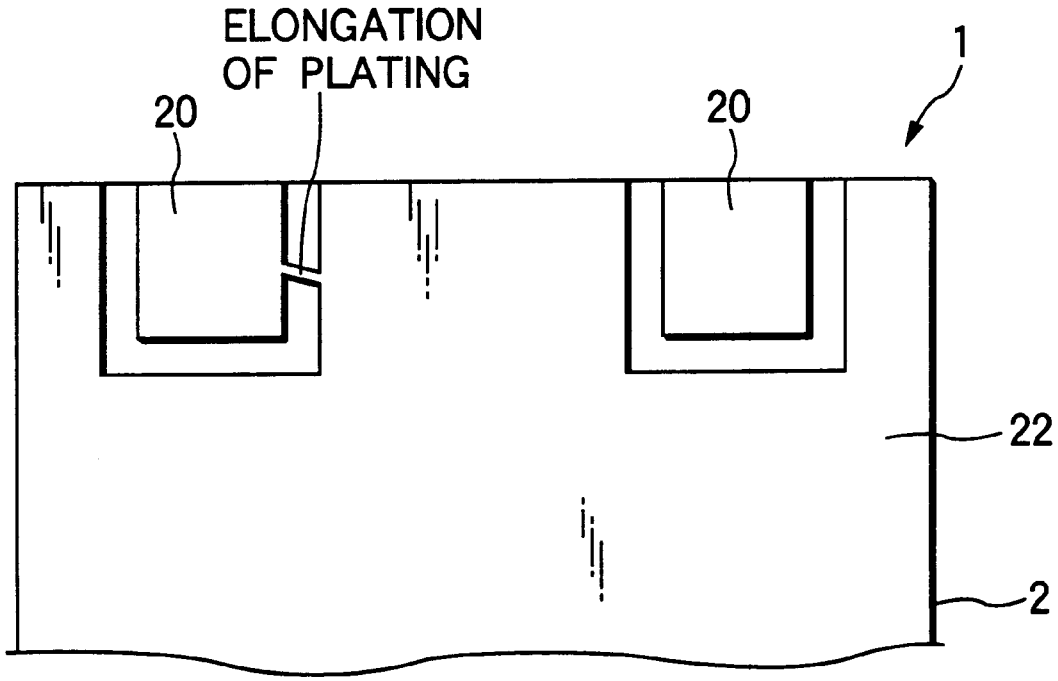
FIG. 15 is a front view showing drawbacks arising when terminal electrodes are formed on a related-art dielectric filter by means of plating.

As shown in FIG. 3A, in the present embodiment, the dielectric protrusions 45—which protrude higher than the exterior conductor provided on the terminal electrodes 60*a* and 60*b*—are formed between the terminal electrodes 60*a* and 60*b* and between the terminal electrodes 60*a* and 60*b* and the ground electrode 62 on the side surface 44 of the dielectric porcelain block 42. Hence, even when the dielectric porcelain block 42 is mounted on a circuit board 31 having electrodes 32*a* and 32*b* coated with the cream solder layers 33*a* and 33*b* similar to those shown in FIG. 14, the dielectric porcelain block 42 can be joined to the circuit board 31 without involvement of occurrence of solder bridges, which would otherwise arise between the terminal electrodes 60*a* and 60*b* in the same manner as in FIG. 3B.

In order to prevent occurrence of soldering failures, the extent T to which the protuberance 45 is to protrude from the surface of the exterior conductor 62 shown in FIG. 3 is preferably set to 300 microns or less. If a gap arising between electrodes on the circuit board 31 and the terminal electrodes 60*a* and 60*b* exceeds a value of 100 microns or thereabouts, solder may stick to only the electrodes of either the circuit board 31 or to those of the dielectric porcelain block 42, for reasons of a self-alignment characteristic of solder. Even in consideration of such a self-alignment characteristic of solder, the extent T is preferably set to 150 microns or less. By means of such a construction, a gap arising between the surface of electrodes of a circuit board and the surfaces of the terminal electrodes 60*a* and 60*b* of the dielectric filter is maintained at a level appropriate for soldering (e.g., 100 microns or less), thus ensuring soldering.

The protrusions 45 are formed on the dielectric porcelain block 42 beforehand, thereby yielding advantages in terms of positional precision and the number of man-hours involved. The protrusions may be formed by means of injection molding, ordinary powder compression molding, or subjecting a rectangular-parallelepiped dielectric porcelain block to post-treatment. When an attempt is made to form a structure having protruding elements provided thereon, metal molds for powder compression molding become complex and difficult to materialize. Designing metal molds for injection molding is easy and very advantageous. Further, injection molding is superior to powder compression molding in terms of homogeneity of molding density.

According to the manufacturing method shown in FIGS. 2A through 2C, a conductor layer may be provided on the dielectric porcelain block by means of immersing the dielectric porcelain block into a conductor paste such as silver.

The first embodiment yields the following advantages.

(1) The plurality of resonators 50 are formed by means of coating the interior surfaces of through sections with the interior conductor 54, wherein each of the through sections is formed from the through hole 51 and the cup-shaped recess 52. In a case where the plurality of resonators 50 are provided side by side in the dielectric porcelain block 42, the protrusions 45 are formed on the side surface 44 perpendicular to the open end face 43 having the through holes 51 formed therein. The protrusions 45 are shorter than the through sections (each consisting of the through hole 51 and the cup-shaped recess 52) in the axial direction of the trough sections. The dielectric protrusions 45 are located between the I/O terminal electrodes 60*a* and 60*b* and between the I/O terminal electrodes 60*a* and 60*b* and the exterior conductor 62 (i.e., the ground electrode). Hence, when the dielectric porcelain block 42 is mounted on the circuit board 31 by means of cream solder, the amount of solder which enters the exposed dielectric of the protrusions 45 from electrodes becomes less, thereby eliminating squeezing out of solder to adjacent electrodes. Consequently, there can be prevented occurrence of a short circuit, which would otherwise be caused by solder bridges.

(2) Two upwardly-oriented C-shaped protrusions 45 are provided on the same plane, and the tip ends of the C-shaped protrusions 45 are arranged so as to come into contact with the open end face 43. Consequently, the protrusions 45 can define the I/O terminal electrodes 60*a* and 60*b* such that the I/O terminal electrodes 60*a* and 60*b* are electrically isolate and separate from the exterior conductor 62 without fail.

(3) The terminal electrodes 60*a* and 60*b* are formed with the protrusions 45 being taken as a boundary therebetween. As a result of the protrusions 45 having been formed on a side surface beforehand, the positional accuracy of the terminal electrodes 60*a* and 60*b* can be improved, thereby diminishing variations in the filtering characteristic of the dielectric filter.

(4) The extent to which the protuberance 45 is to protrude from the surface of the exterior conductor 62 is larger than the thickness of the exterior conductor formed on the same side surface. Hence, when the dielectric porcelain block 42 is mounted on the circuit board 31, the protrusions 45 protruding from the exterior conductor 62 prevent cream solder from squeezing out to adjacent electrodes, thereby reliably eliminating occurrence of a short circuit, which would otherwise be caused by solder bridges. If the extent T to which the protuberance 45 is to protrude from the surface of the exterior conductor 62 is set to 300 microns or less, a gap arising between the surface of electrodes of the circuit board 31 and the surfaces of the terminal electrodes 60*a* and 60*b* of the dielectric filter becomes appropriate, thereby enabling proper soldering of the dielectric filter to the circuit board 31. If the extent T is set to 150 microns or less, the gap arising between the surface of electrodes of the circuit board 31 and the surfaces of the terminal electrodes 60*a* and 60*b* assumes a value of 100 microns or less. Thus, an appropriate gap can be maintained in consideration of solder sticking to only the electrodes of either the circuit board 31 or to those of the dielectric porcelain block 42, which would be induced by a self-alignment characteristic of solder. Thus, the dielectric filter can be soldered to the circuit board 31 more appropriately.

(5) The dielectric porcelain block 42 is molded so as to have the protrusions 45, and the dielectric porcelain block 42 including the surfaces of the protrusions 45 are coated with a conductor layer. Subsequently, the upper end faces of the protrusions 45 are abraded, as a result of which the surface of the dielectric porcelain block 42 is exposed. The terminal electrodes 60*a* and 60*b* are defined by the respective protrusions 45. The terminal electrodes 60*a* and 60*b*, the interior conductor 54, and the exterior conductor 62 can be produced with good productivity by utilization of the plating technique. The protrusions 45 of dielectric substance are present between the terminal electrodes 60*a* and 60*b* so as to determine a boundary between the terminal electrodes 60*a* and 60*b*, thus preventing a short circuit, which would otherwise be caused by elongating of plating. When the entire surface of the dielectric porcelain block 42 is plated while resist is applied to the open-end face 43, the terminal electrodes 60*a* and 60*b* become island-shaped floating electrodes. Further, when the dielectric porcelain block 42 is electrically plated, a reduction arises in the thickness or strength of plating. Since the present method prevents occurrence of floating electrodes, the foregoing problems do not arise. Thus, there can be formed terminal electrodes having stable strength and thickness.

(6) The dielectric porcelain block 42 is formed by means of injection molding such that the protrusions 45 having a height smaller than that of the through section 51 are formed on the side surface 44 perpendicular to the open end face 43 of the dielectric porcelain block 42 having the through holes 51 formed therein. The protrusions 45 having complicated geometries can be formed by means of injection molding, thus enabling formation of terminal electrodes of various patterns.

Figure 4:
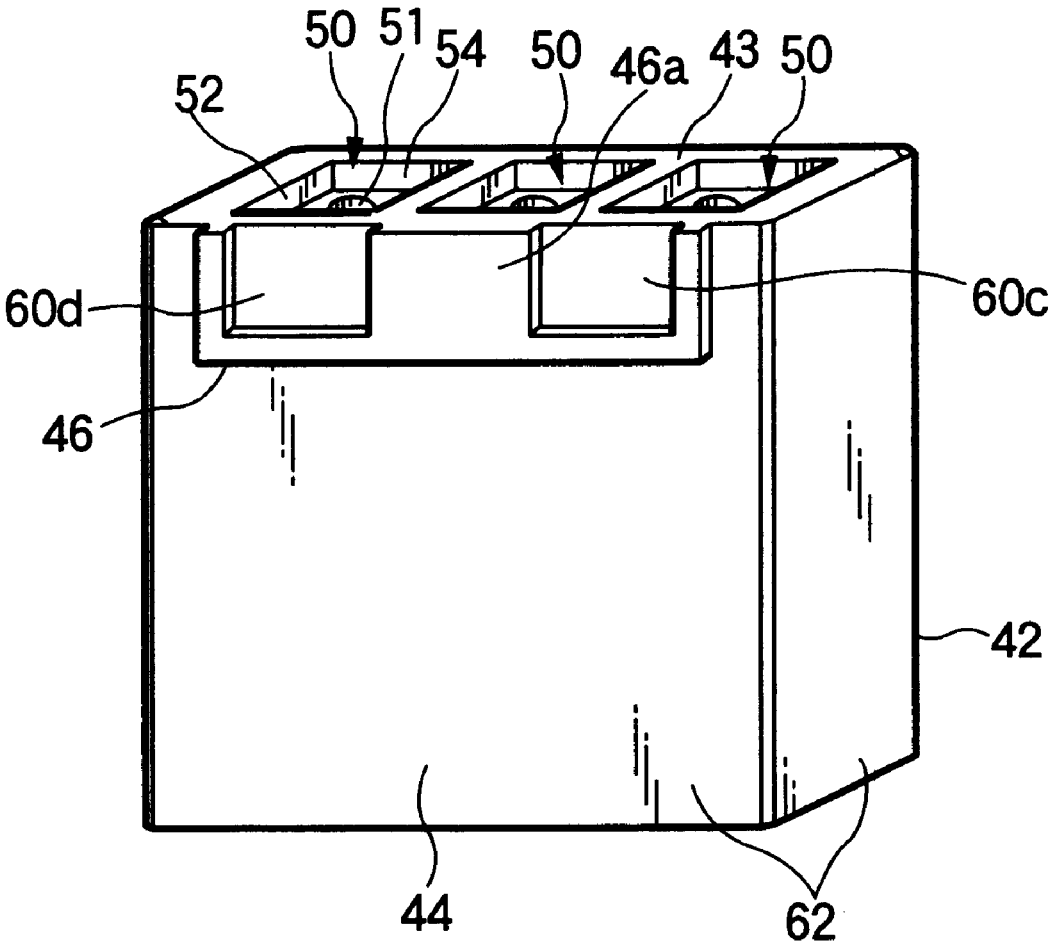
FIG. 4 is a perspective view showing a dielectric filter according to a second embodiment of the present invention.

FIG. 4 shows a dielectric filter according to a second embodiment of the present invention. An upwardly-oriented E-shaped protuberance 46 is formed on the side surface 44 of the dielectric porcelain block 42. Terminal electrodes 60*c* and 60*d* are formed with the protuberance 46 being taken as a boundary. In other respects, the dielectric filter is identical in construction with that described in connection with the first embodiment.

In the case of the dielectric filter according to the second embodiment, the terminal electrodes 60*c* and 60*d* are formed with the protuberance 46 taken as a boundary, thus improving the positional accuracy of the terminal electrodes 60*c* and 60*d*. Further, variations in the filtering characteristic of the dielectric filter can be diminished. A portion of the protuberance 46 (i.e., a center projection 46*a*) is located between the adjacent terminal electrodes 60*c* and 60*d*. Since the exterior conductor 62 serving as a ground electrodes does not enter between the terminal electrodes 60*c* and 60*d*. Hence, capacitive coupling between the resonators 50 is made relatively stronger, thus broadening a pass band. In this case, the effect can be made greater, by means of dielectric protrusions being interposed between the terminal electrodes 60*c* and 60*d* as well as by means of preventing extension of the exterior conductor 62 between the terminal electrodes 60*c* and 60*d*. In other respects, the dielectric filter is identical in working-effect with that described in connection with the first embodiment.

Figure 5:
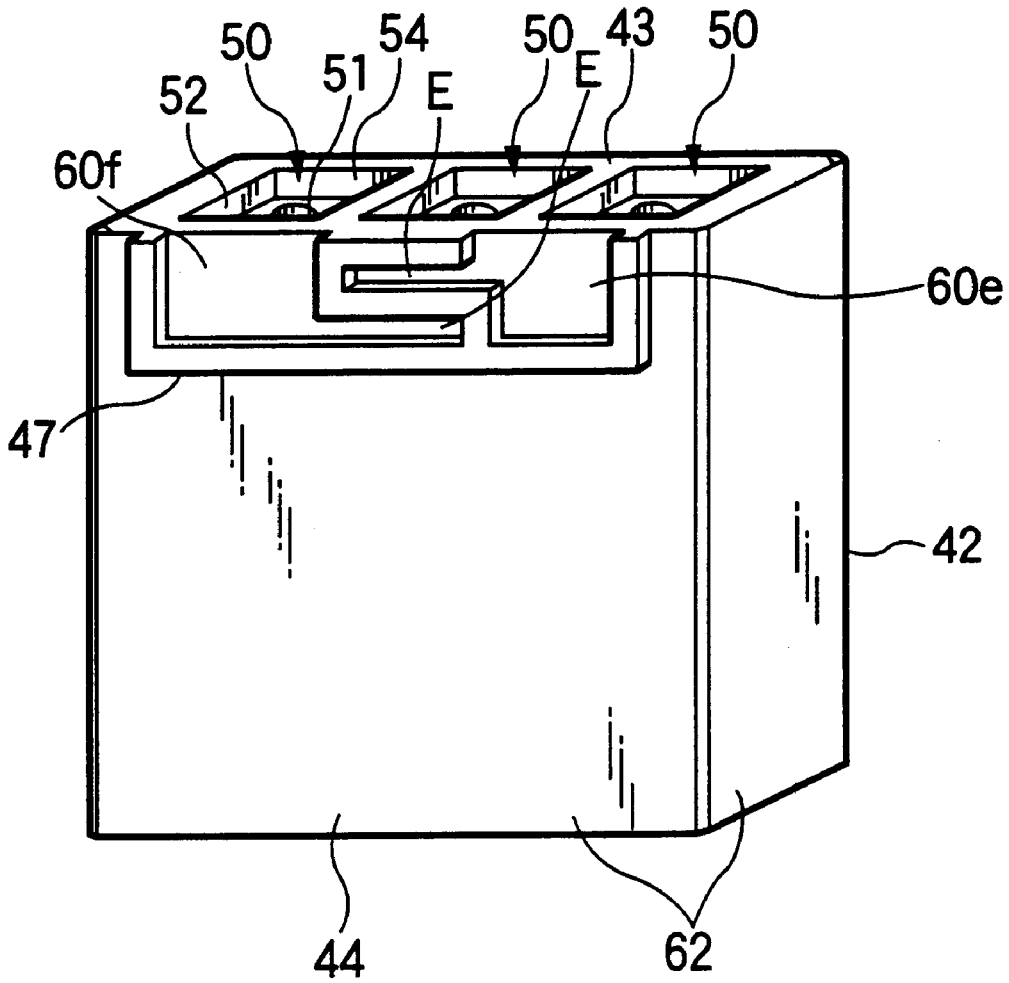
FIG. 5 is a perspective view showing a dielectric filter according to a third embodiment of the present invention.
Figure 6A:
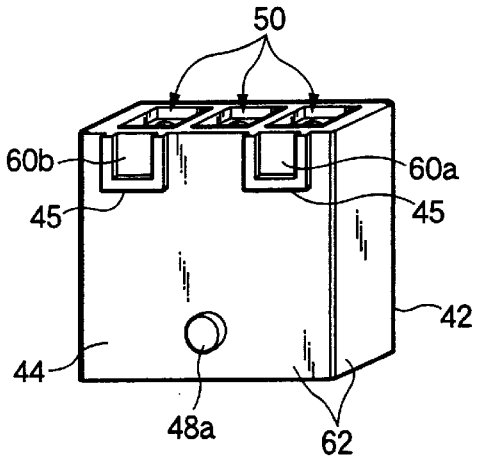
FIG. 6A is a perspective view showing a dielectric filter according to a fourth embodiment of the present invention.
Figure 6B:
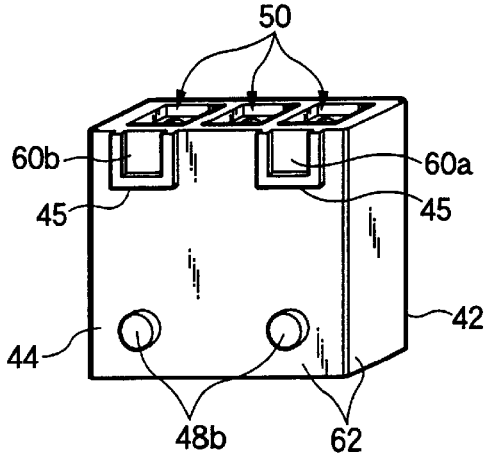
FIG. 6B is a perspective view showing a dielectric filter according to a fifth embodiment of the present invention.
Figure 6C:
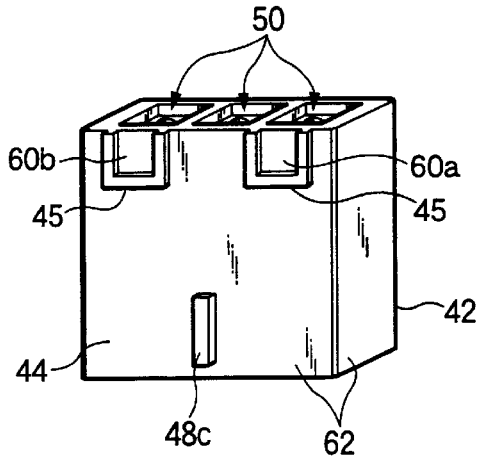
FIG. 6C is a perspective view showing a dielectric filter according to a sixth embodiment of the present invention.
Figure 6D:
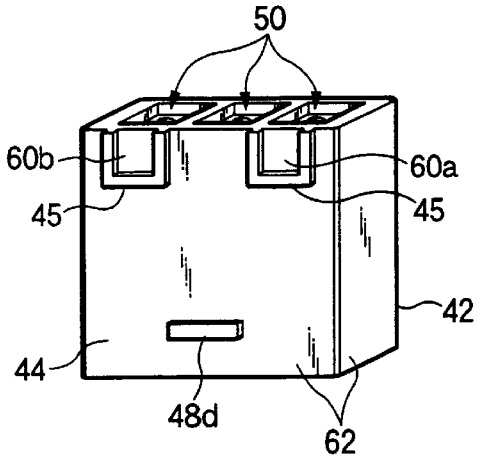
FIG. 6D is a perspective view showing a dielectric filter according to a seventh embodiment of the present invention.

FIG. 5 shows a dielectric filter according to a third embodiment of the present invention. An upwardly-oriented substantially-E-shaped protuberance 47 is formed on the side surface 44 of the dielectric porcelain block 42. Terminal electrodes 60*e* and 60*f* are formed with the protuberance 47 being taken as a boundary therebetween. The terminal electrodes 60*e* and 60*f* are formed from square portions. A strip-shaped extension E extends from each of the square portions such that the extensions E become close to each other. In other respects, the dielectric filter is identical in construction with that described in connection with the second embodiment.

In addition to the protuberance to be used for defining a terminal electrode, a protuberance to be used for stabilization during mounting of a dielectric filter can be formed on the side surface of the dielectric porcelain block. FIGS. 6A through 6D show a dielectric filter having such a protuberance. In a fourth embodiment of the present invention shown in FIG. 6A, a fifth embodiment of the present invention shown in FIG. 6B, a sixth embodiment of the present invention shown in FIG. 6C, and a seventh embodiment of the present invention shown in FIG. 6D, one or a plurality of protrusions 48*a*, 48*b*, 48*c*, and 48*d* are provided on the side surface 44 of the dielectric porcelain block 42 in positions other than the boundary between the terminal electrodes 60*a* and 60*b*, in addition to the upwardly-oriented C-shaped protrusions 45 described in connection with the first embodiment. As can be seen from these drawings, a protuberance(s) is provided in arbitrary positions on the side surface (in terms of stabilization of the dielectric filter during mounting operation, an additional protuberance(s) is preferably provided in a lower position on the side surface spaced a certain distance away from the protrusions 45 provided in an upper position on the side surface). The additional protuberance(s) assumes an arbitrary geometry, such as a circular shape or a rectangular shape. In terms of electrical characteristic, the protrusions 48*a*, 48*b*, 48*c*, and 48*d* are preferably coated with the exterior conductor 62. In other respects, the dielectric filters described in connection with the fifth through seventh embodiments are identical with that described in connection with the first embodiment.

When a dielectric filter is mounted with a terminal surface thereof facing down or when a plurality of dielectric filters are mounted side by side, the filters may be inclined out of balance. Since the protrusions 48*a*, 48*b*, 48*c*, and 48*d* are provided at positions other than the boundary between the terminal electrodes 60*a* and 60*b*, stability required for mounting the dielectric filter on a circuit board can be ensured reliably. In other respects, the dielectric filters yields the same working-effect as that yielded by the dielectric field described in connection with the first embodiment.

Figure 7:
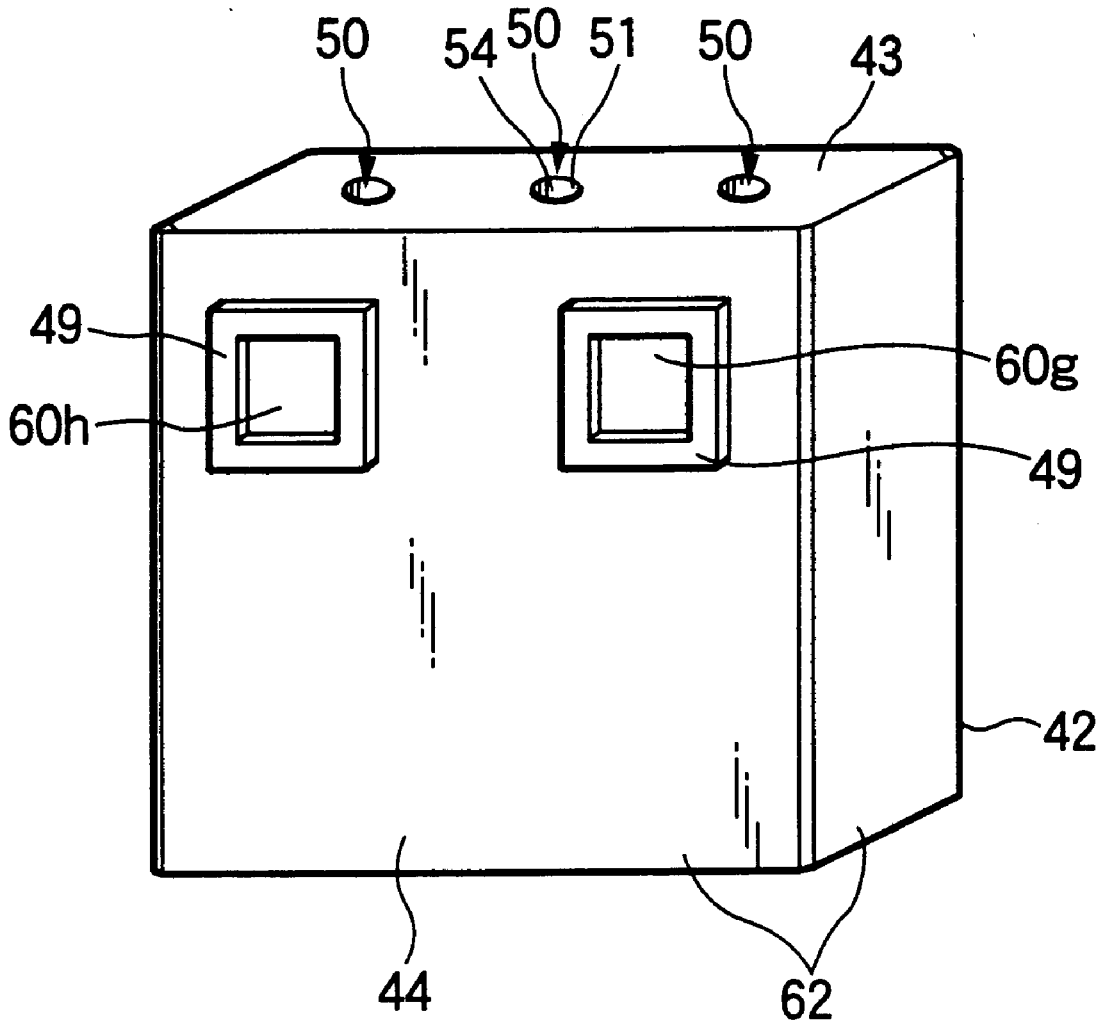
FIG. 7 is a perspective view showing a dielectric filter according to an eighth embodiment of the present invention.

FIG. 7 shows a dielectric filter according to an eighth embodiment of the present invention. In this case, protrusions 49 act as boundaries between the terminal electrodes 60*g* and 60*h* and the exterior conductor 62. The protrusions 49 assume the shape of a square frame. The terminal electrodes 60*g* and 60*h* can be placed at arbitrary positions on the side surface 44 of the dielectric porcelain block 42 in the axial direction of the through holes 51 serving as through sections. In short, the terminal electrodes 60*g* and 60*h* are arranged so as to be spaced away from the open-end face. As a result, such a construction can cope with a case where the interior conductor 54 is provided so as to extend to any position on the through hole 51. In terms of construction and working-effect, the dielectric filter according to the eighth embodiment is identical with that described in connection with the first embodiment. In this case, the open end 43 has no cup-shaped recess, and hence the length of a through section is defined as being equal to the length of the through hole 51.

Figure 8:
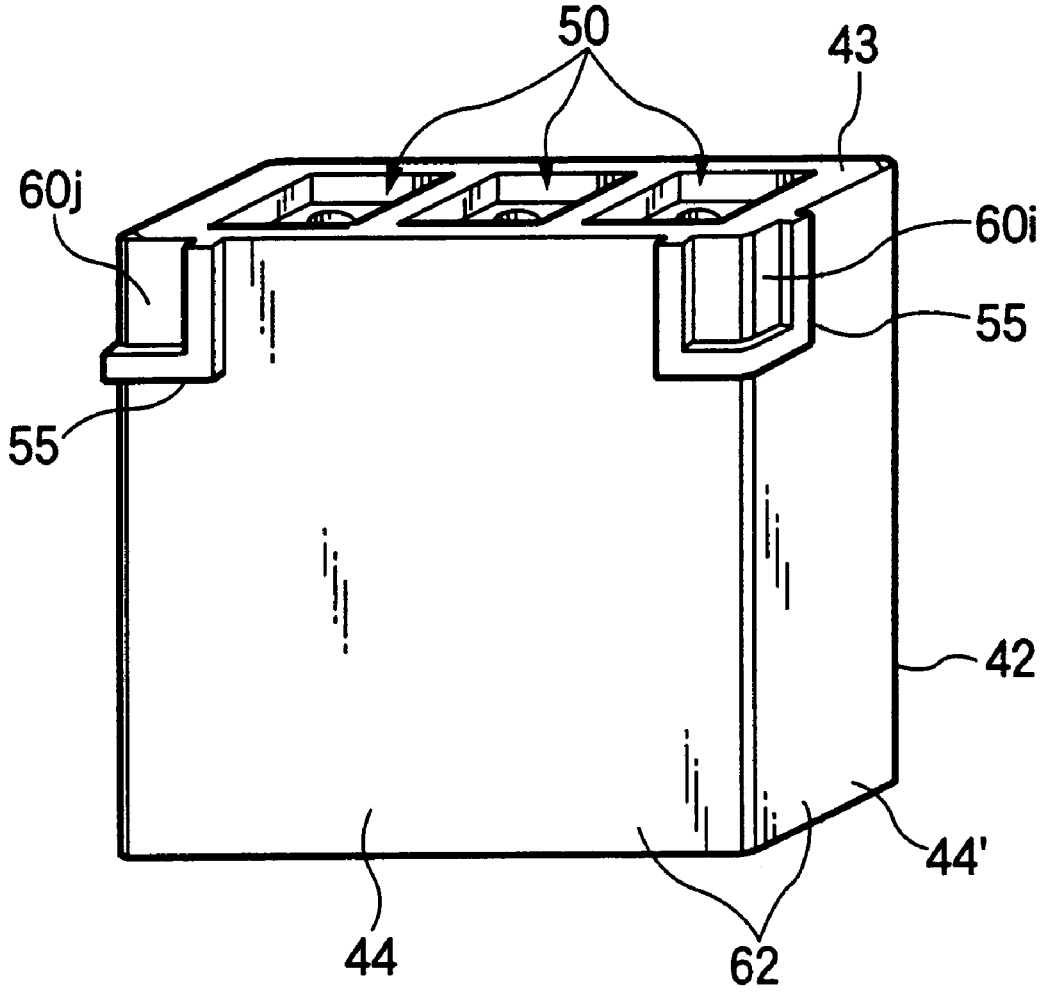
FIG. 8 is a perspective view showing a dielectric filter according to a ninth embodiment of the present invention.

There is no necessity of forming terminal electrodes on only one surface of the dielectric filter. Terminal electrodes may be formed so as to spread across two or more surfaces of the dielectric porcelain block. Such a dielectric filter is described as a ninth embodiment of the present invention, by reference to FIG. 8. In this embodiment, each of the upwardly-oriented C-shaped protrusions 55 is formed so as to spread two side surfaces 44 and 44' of the dielectric porcelain block 42. Consequently, terminal electrodes 60*i* and 60*j* are formed so as to be isolated and separated from the exterior conductor 62 by means of the upwardly-oriented protrusions 55 such that each of the terminal electrodes spreads across two surfaces. In other respects, the dielectric filter is identical in construction with that described in the first embodiment.

In the ninth embodiment, since the terminal electrodes 60*i* and 60*j* are provided such that each of the terminal electrodes spreads across two surfaces of the dielectric porcelain block 42, there is achieved a higher degree of freedom in laying out a dielectric filter on a circuit board. In other respects, the dielectric filter is identical in working-effect with that described in connection with the first embodiment.

Figure 9:
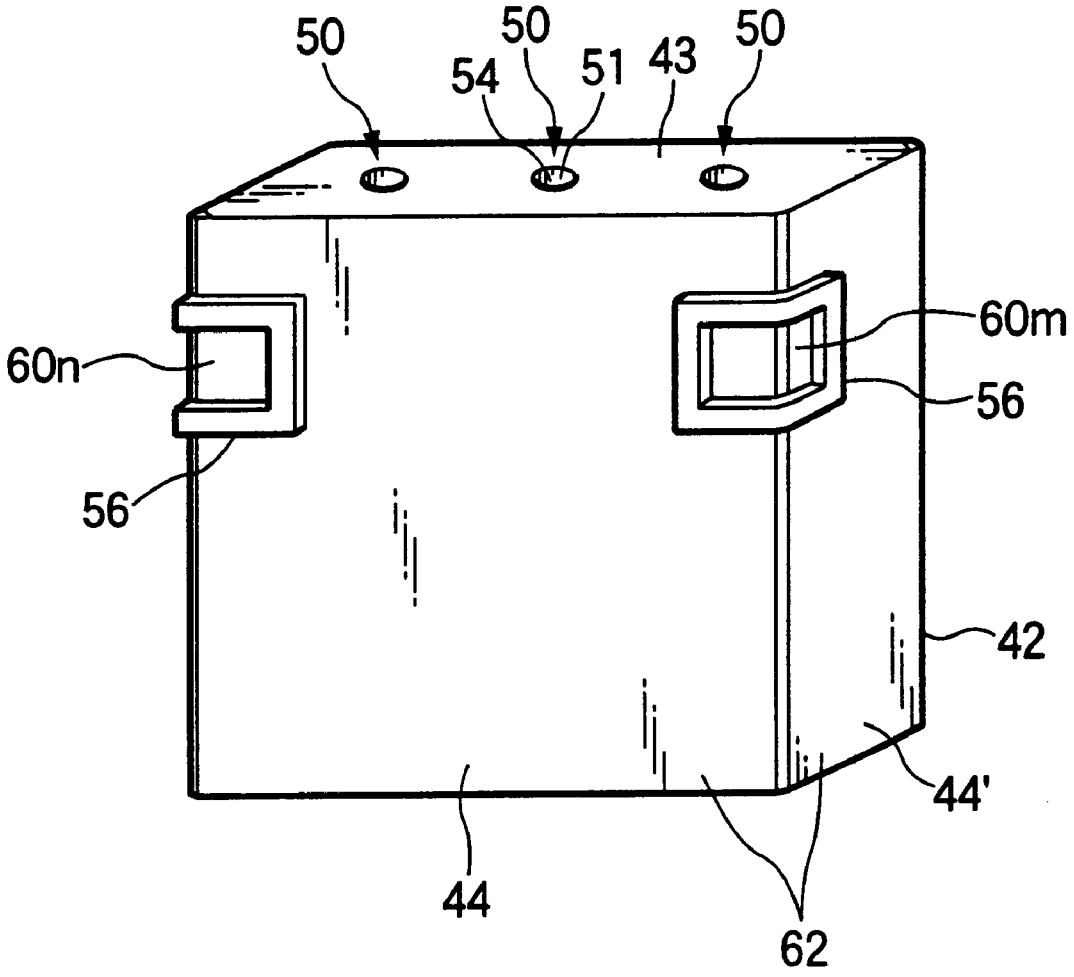
FIG. 9 is a perspective view showing a dielectric filter according to a tenth embodiment of the present invention.

Terminal electrodes are not necessarily formed on an open-end face and may be formed so as to spread across two or more surfaces. A dielectric filter having such a layout will be described as a tenth embodiment of the present invention by reference to FIG. 9. In this example, the square-frame-shaped protrusions 56 are formed such that each of the protrusions 56 spreads across two or more surfaces 44 and 44'. Consequently, terminal electrodes 60*m* and 60*n* are formed so as to be isolated and separated from the exterior conductor 62 by means of the square-frame-shaped protrusions 56 such that each of the terminal electrodes 60*m* and

60*n* spreads across two surfaces. In other respect, the dielectric filter is identical with that described in connection with the first embodiment (the filter having no cup-shaped recesses).

In the tenth embodiment, since each of the terminal electrodes 60*m* and 60*n* is entirely surrounded by the square-frame-shaped protuberance 56, the terminal electrodes 60*m* and 60*n* can be provided at arbitrary positions on the side surfaces 44 and 44' of the dielectric porcelain block 42 in the axial direction of the through holes 51. More specifically, the terminal electrodes can be arranged so as not to come into contact with the open-end surface. For instance, the dielectric filter can cope with a case where the interior conductor 54 is provided so as to extend to any position on the through hole 51. Since the terminal electrodes 60*m* and 60*n* is provided such that each of the terminal electrodes spreads across two surfaces of the dielectric porcelain block 42, there is achieved a higher degree of freedom in laying out a dielectric filter on a circuit board. In other respects, the dielectric filter is identical in working-effect with that described in connection with the first embodiment.

Figure 10A:
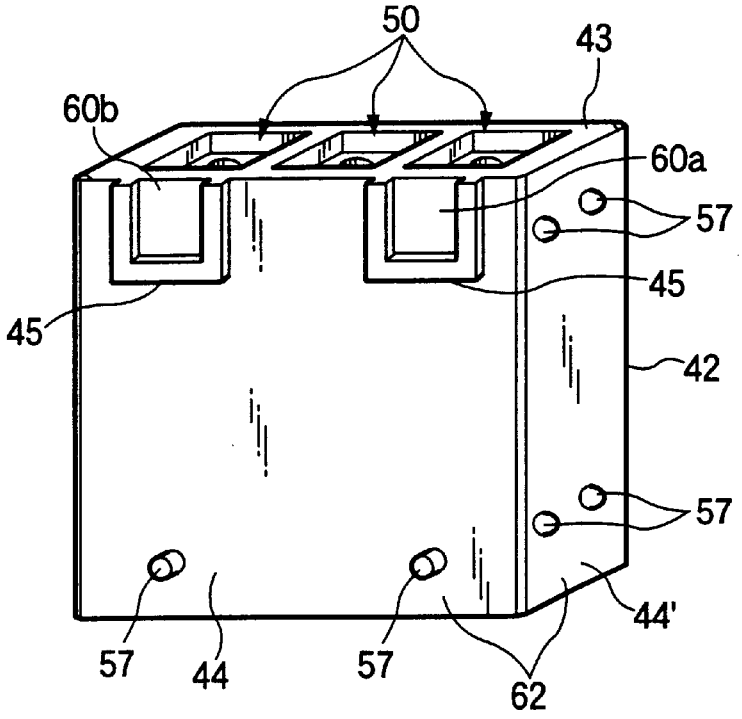
FIGS. 10A and 10B are perspective views showing a dielectric filter according to an eleventh embodiment of the present invention.
Figure 10B:
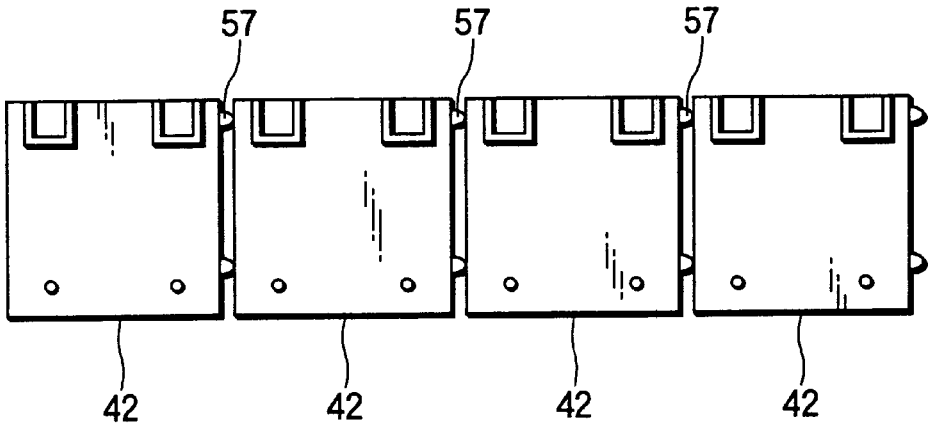

FIGS. 10A and 10B show the structure of a dielectric filter effective for preventing molded bodies of dielectric porcelain blocks from sticking each other, which would arise over a wide area at the time of sintering. As shown in FIG. 10A, protrusions 57 are formed at a plurality of positions (e.g. at positions in the vicinity of four corners) on the adjacent side surface 44' perpendicular to the side surface 44 having the terminal electrodes 60*a* and 60*b* of the dielectric porcelain block 42 mounted thereon, as well as on the side surface 44. When molded bodies of dielectric porcelain blocks are sintered while being arranged side by side, as shown in FIG. 11B, there can be reliably prevented occurrence of contact between the molded bodies over a wide area, which would otherwise be caused as a result of the molded bodies coming into contact with each other. The protrusions 57 to be provided on the adjacent side surface 44' can be formed into, for example, semi-spherical protrusions. As a result, the area of contact between molded bodies can be reduced to a much greater extent. In other respect, the dielectric filter yields the same working-effect as that yielded by the dielectric filter according to the first embodiment.

The protrusions 57 may be provided on all four side surfaces of the dielectric porcelain block 42 for the same purpose.

Figure 11A:
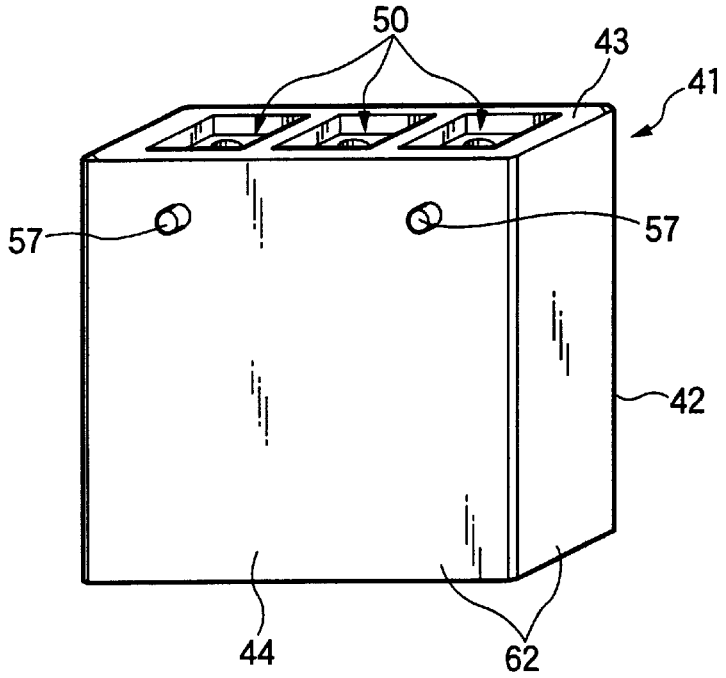
FIGS. 11A and 11B are perspective views showing a dielectric filter according to a twelfth embodiment of the present invention.
Figure 11B:
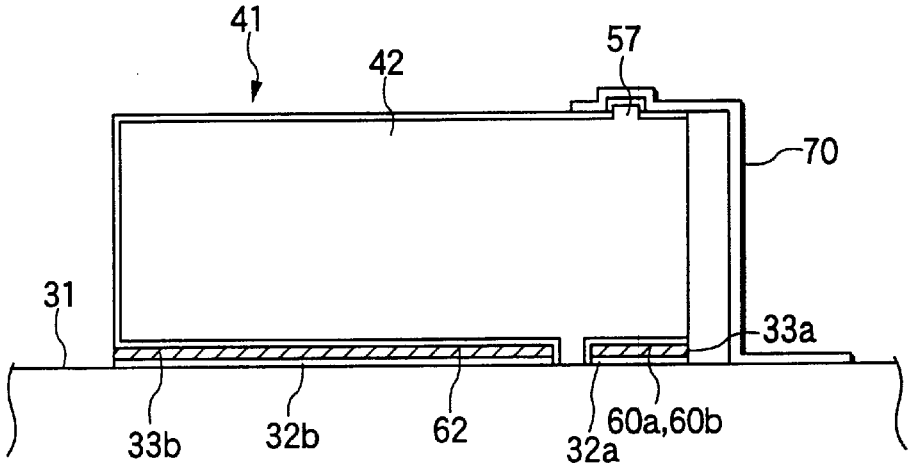

FIGS. 11A and 11B show a dielectric filter according to a twelfth embodiment of the present invention. As has been shown in connection with the eleventh embodiment of the present intention, the protrusions 57 are utilized for positioning a shield plate 70 which shields the open end face 43 of the dielectric porcelain block 42 in the manner as described in connection with the eleventh embodiment. As shown in FIG. 11A, the protrusions 57 are provided on the surface of the dielectric porcelain block 42 opposite to that having terminal electrodes provided thereon. The dielectric filter 41 is mounted to the circuit board 31 by utilization of the terminal electrodes 60*a* and 60*b* through soldering. When the shield plate 70 is fixed on the circuit board 31 in the same manner as in the embodiment shown in FIG. 3, the protrusions 57 can position the shield 70 (those elements which are identical with or correspond to the element shown in FIG. 3 are assigned the same reference numerals). In other respects, the dielectric filter is identical in working-effect with that described in connection with the first embodiment.

Figure 12A:
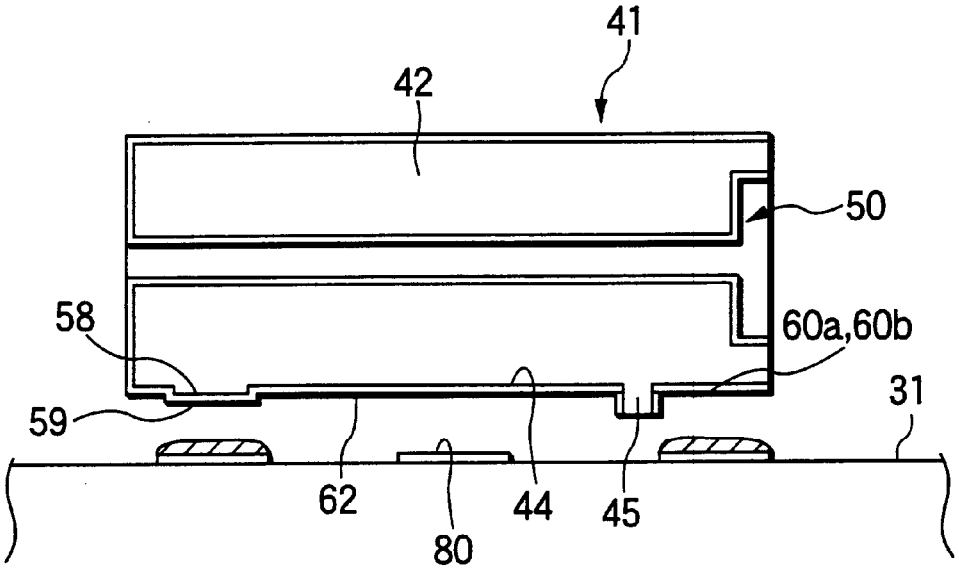
FIGS. 12A and 12B are perspective views showing a dielectric filter according to a thirteenth embodiment of the present invention.
Figure 12B:
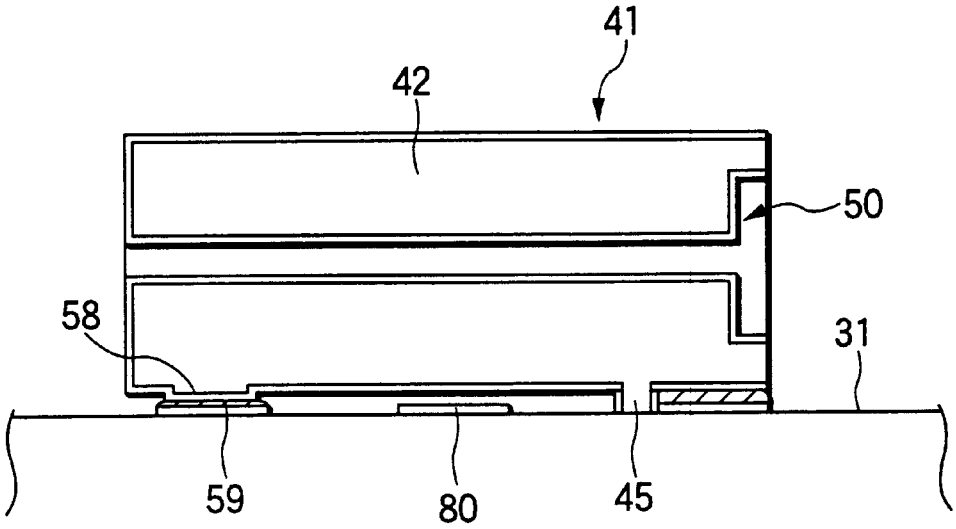
Figure 13A:
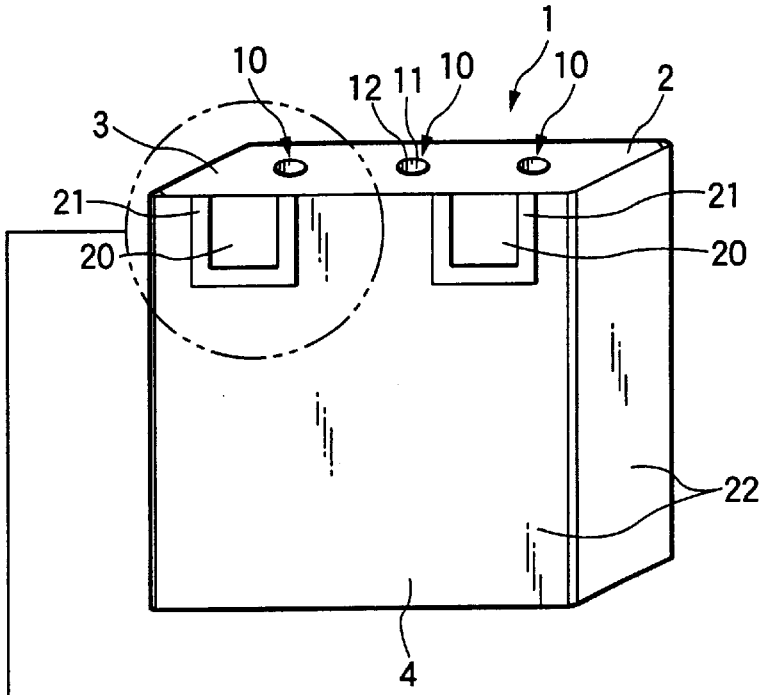
FIGS. 13A and 13B are perspective views showing a related-art dielectric filter.
Figure 13B:
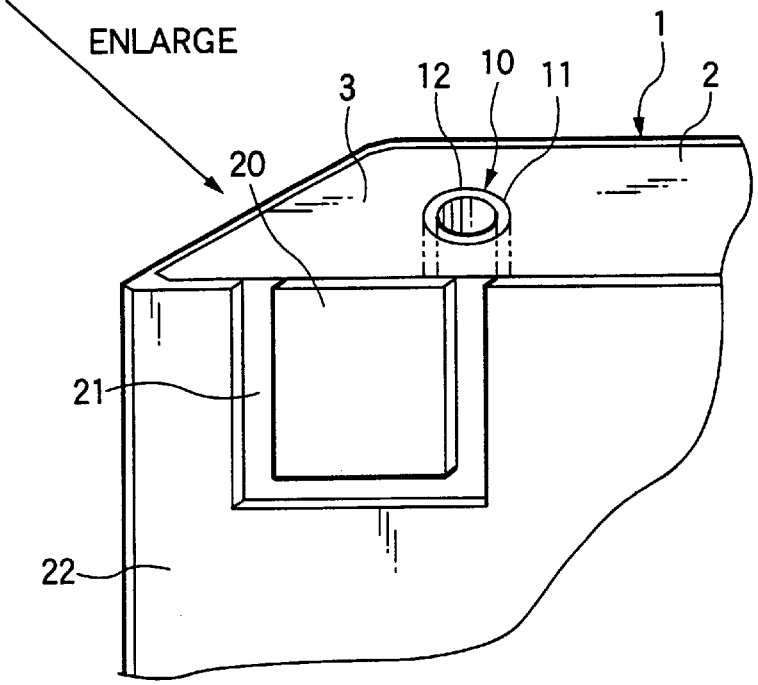

FIGS. 12A and 12B show a dielectric filter according to a thirteenth embodiment of the present invention. As shown in FIG. 12A, a protuberance 58 to be formed at a position other than the boundary between the terminal electrodes 60*a* and 60*b* is formed on the same side surface on which the terminal electrodes 60*a* and 60*b* are provided and at a position in the vicinity of the end section opposite to the end section close to the protuberance 45. More specifically, the protuberance 58 is formed at a position close to the bottom surface of the dielectric porcelain block 42. Further, the protuberance 58 is coated with the exterior conductor 62, thus constituting a ground terminal 59. As shown in FIG. 12B, the areas to be used for mounting can be defined by the surfaces of the terminal electrodes 60*a* and 60*b* and the surface of the ground terminal electrode 59. When the dielectric filter 41 is soldered to the circuit board 31 by means of the terminal electrodes 60*a* and 60*b* and the ground terminal electrode 59, another circuit conductor pattern 80 may be placed on the circuit board 31 by utilization of a gap between the protrusions 45 defining the terminal electrodes 60*a* and 60*b* and the protuberance 58. Here, the protrusions 45 are not required to be identical in height with the protuberance 58. In other respects, the dielectric filter is identical with that described in connection with the first embodiment.

If the front and back of each of the side surfaces of the dielectric porcelain block is given orientation, the protrusions described in the preceding embodiments maybe used as protrusions for identifying an orientation.

The cup-shaped recesses are formed in the open end face of the dielectric porcelain block so as to become continuous from the respective through holes. However, cup-shaped recesses are formed for making the filter characteristic of the dielectric filter for a required application. Hence, the cup-shaped recesses can be obviated. Further, the number of resonators (i.e., the number of stages of dielectric filters), each resonator being formed from an interior conductor applied over a through hole formed in the dielectric porcelain block, can be increased or decreased, as required.

As has described in connection with the embodiments, the present invention is not limited to the embodiments. It is obvious to those who are skilled in the art that the present invention is susceptible to various modifications or alterations within the scope of the invention described in the appending claims.

As described above, according to the present invention, when terminal electrodes are provided on a side surface of a dielectric block, dielectric protrusions are located between the electrodes. Hence, when the dielectric porcelain block is mounted on a circuit board by means of cream solder, the amount of solder which enters the exposed dielectric of the protrusions from electrodes becomes less, thereby eliminating squeezing out of solder to adjacent electrodes. Consequently, there can be prevented occurrence of a short circuit, which would otherwise be caused by solder bridges.

One or more protrusions are provided on at least one of the side surfaces of the dielectric porcelain block during molding. As a result, there can be prevented occurrence of contact between molded bodies over a wide area. Consequently, there can be prevented failures, which would otherwise be caused when molded bodies come into contact with each other over a wide area during sintering.

Protrusions are formed so as to protrude from the exterior conductor provided on the side surfaces and bottom surface of the dielectric porcelain block. As a result, squeezing out of cream solder to adjacent electrodes can be prevented more reliably, thus eliminating occurrence of a short circuit, which would otherwise be caused by solder bridges.

When terminal electrodes are formed by means of plating, there may be employed a method in which protrusions—which have been formed on a side surface beforehand after the entire surface of a dielectric porcelain block exclusive of an open end face has been plated—are abraded, thus eliminating the conductor layer from the top of each of the protrusions and forming terminal electrodes. The positional precision of the electrodes can be improved, and the number of steps for forming a resist mask can be diminished. Further, protrusions are formed between terminal electrodes so as to constitute a boundary between the terminal electrodes, thereby preventing occurrence of a short circuit, which would otherwise be caused by elongation of plating.

When the entire surface of a dielectric porcelain block is plated after resist has been applied over an open end face according to the related-art method, terminal electrodes become island-shaped floating electrodes. When the dielectric porcelain block is electrically plated, a reduction arises in the thickness or strength of plating. Since the present method prevents occurrence of floating electrodes, the foregoing problems do not arise. Thus, there can be formed terminal electrodes having stable strength and thickness.

Accordingly, there can be provided a dielectric filter which is superior in ease of mounting, provides high yield when electrodes are formed by plating, and has a stable film thickness.

What is claimed is:

1. A dielectric filter comprising:

a dielectric block;

a plurality of resonators formed in the dielectric block side by side, each resonator being formed by coating an interior surface of a through section with an interior conductor; and at least one protrusion having a height less than or equal to 300 microns on a side surface of the dielectric block perpendicular to an open end face having the through sections formed therein.

2. A dielectric filter, comprising:

a dielectric block;

a plurality of resonators formed in the dielectric block side by side, each resonator being formed by coating an interior surface of a through section with an interior conductor; and at least one protrusion having a height lower than that of the through sections on a side surface of the dielectric block perpendicular to an open end face having the through sections formed therein, wherein each of the protrusions is formed so as to spread across two or more side surfaces.

3. The dielectric filter according to claim 1, wherein a plurality of protrusions are formed on the same plane.

4. The dielectric filter according to claim 1, wherein terminal electrodes are formed on a side surface of the dielectric block perpendicular to an open end face having the through sections formed therein such that the protrusions are located as a boundary between the terminal electrodes.

5. The dielectric filter according to claim 4, wherein the protrusions are located at least between adjacent terminal electrodes.

6. A dielectric filter, comprising:

a dielectric block;

a plurality of resonators formed in the dielectric block side by side, each resonator being formed by coating an interior surface of a through section with an interior conductor; and at least one protrusion having a height lower than that of the through sections on a side surface of the dielectric block perpendicular to an open end face having the through sections formed therein, wherein the protrusions are provided in a position other than the boundary between the terminal electrodes formed on a side surface of the dielectric block perpendicular to an open end face having the through sections formed therein.

7. The dielectric filter according to claim 1, wherein the extent to which the protrusions are to protrude from a side surface of the dielectric block is greater than the thickness of an exterior conductor formed on the side surface.

8. The dielectric filter according to claim 1, wherein the interior and exterior conductor layers are formed by plating.

9. A method of manufacturing a dielectric filter formed from a dielectric block and a plurality of resonators formed in the dielectric block side by side, each resonator being formed by coating an interior surface of a through section with an interior conductor, the method comprising the steps of:

molding the dielectric block such that protrusions having a height lower than that of the through sections are formed on a side surface of the dielectric block perpendicular to an open end face having the through sections formed therein;

coating the dielectric block including the surfaces of the protrusions with a conductor layer; and abrading tops of the protrusions to have a height less than or equal to 300 microns, thereby causing the surface of the dielectric block to become exposed and forming electrodes defined by the protrusions.

10. The dielectric filter according to claim 1, wherein said at least one protrusion has a height less than or equal to 150 microns.

11. The method according to claim 9, wherein said molding step comprises molding protrusions having a height less than or equal to 150 microns.

12. The method according to claim 10, wherein the forming step comprises forming protrusions having a height less than or equal to 150 microns.

* * * * *